US011341926B2

(12) United States Patent
Lu et al.

(10) Patent No.: US 11,341,926 B2
(45) Date of Patent: May 24, 2022

(54) BACKLIGHT MODULE, CONTROL METHOD THEREFOR AND DISPLAY DEVICE, DRIVING METHOD THEREFOR

(71) Applicants: Beijing BOE Optoelectronics Technology Co., Ltd., Beijing (CN); BOE Technology Group Co., Ltd., Beijing (CN)

(72) Inventors: Zhenghua Lu, Beijing (CN); Zongze He, Beijing (CN); Zhiming Meng, Beijing (CN); Shuo Li, Beijing (CN); Jianguang Yang, Beijing (CN); Zhipeng Feng, Beijing (CN); Liang Zhang, Beijing (CN); Yuxuan Chen, Beijing (CN); Feng Long, Beijing (CN)

(73) Assignees: Beijing BOE Optoelectronics Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 639 days.

(21) Appl. No.: 16/318,212

(22) PCT Filed: Apr. 25, 2018

(86) PCT No.: PCT/CN2018/084492
§ 371 (c)(1),
(2) Date: Jan. 16, 2019

(87) PCT Pub. No.: WO2019/041846
PCT Pub. Date: Mar. 7, 2019

(65) Prior Publication Data

US 2021/0343252 A1 Nov. 4, 2021

(30) Foreign Application Priority Data

Aug. 31, 2017 (CN) ..... 201710776031.X

(51) Int. Cl.
*G09G 3/34* (2006.01)

(52) U.S. Cl.
CPC ..... *G09G 3/3426* (2013.01); *G09G 2310/024* (2013.01); *G09G 2310/0283* (2013.01); *G09G 2310/08* (2013.01); *G09G 2320/0626* (2013.01)

(58) Field of Classification Search
None
See application file for complete search history.

(56) References Cited

U.S. PATENT DOCUMENTS

2008/0150853 A1* 6/2008 Peng ..... G09G 3/3426 345/87
2009/0146942 A1 6/2009 Lee et al.
(Continued)

FOREIGN PATENT DOCUMENTS

CN 101620836 A 1/2010
CN 101663532 A 3/2010
(Continued)

OTHER PUBLICATIONS

Partial European Search Report for 18830356.4 dated Nov. 21, 2019.
(Continued)

*Primary Examiner* — Matthew Yeung
(74) *Attorney, Agent, or Firm* — ArentFox Schiff LLP; Michael Fainberg

(57) ABSTRACT

Disclosed are a backlight module, a control method therefor and a display device, a driving method therefor. A backlight source is divided into light-emitting areas, and a current control circuit for driving the light-emitting area to emit light is configured for each light-emitting area. The light-emitting areas in the backlight module are arranged in one-to-one correspondence to the current control circuits.

14 Claims, 5 Drawing Sheets

(56) References Cited

U.S. PATENT DOCUMENTS

| | | | | |
|---|---|---|---|---|
| 2010/0110112 | A1 | 5/2010 | Nakanishi | |
| 2010/0141572 | A1 | 6/2010 | Kamada | |
| 2011/0134158 | A1* | 6/2011 | Onishi | G09G 3/3426 345/690 |
| 2012/0113159 | A1 | 5/2012 | Chiba et al. | |
| 2012/0147158 | A1 | 6/2012 | Ko | |
| 2013/0070004 | A1 | 3/2013 | Inoue et al. | |
| 2013/0235089 | A1 | 9/2013 | Kang | |
| 2015/0279332 | A1 | 10/2015 | Hu et al. | |
| 2015/0348474 | A1 | 12/2015 | Li et al. | |
| 2018/0373095 | A1* | 12/2018 | Yang | G09G 3/342 |

FOREIGN PATENT DOCUMENTS

| | | | |
|---|---|---|---|
| CN | 102184711 | A | 9/2011 |
| CN | 102469327 | A | 5/2012 |
| CN | 102547318 | A | 7/2012 |
| CN | 102918583 | A | 2/2013 |
| CN | 103943084 | A | 7/2014 |
| CN | 104021768 | A | 9/2014 |
| CN | 104050931 | A | 9/2014 |
| CN | 204242565 | A | 4/2015 |
| CN | 105047140 | A | 11/2015 |
| CN | 105551443 | A | 5/2016 |
| CN | 107331355 | A | 11/2017 |
| WO | 2008104229 | A1 | 9/2008 |

OTHER PUBLICATIONS

Chinese Office Action for 201710776031.X dated Jan. 28, 2019.
International Search report for PCT/CN2018/084492 dated Aug. 7, 2018.

* cited by examiner

BACKLIGHT MODULE, CONTROL METHOD THEREFOR AND DISPLAY DEVICE, DRIVING METHOD THEREFOR

CROSS-REFERENCE OF RELEVANT APPLICATIONS

The present disclosure is a National Stage of International Application No. PCT/CN2018/084492, filed Apr. 25, 2018, which claims priority of Chinese Patent Application No. 201710776031.X entitled "Backlight Module, Control Method Therefor and Display Device" filed in CNIPA on Aug. 31, 2017, both of which are incorporated herein by reference in their entireties.

FIELD

The present disclosure relates to the technical field of displays, in particular to a backlight module, a control method therefor and a display device, a driving method therefor.

BACKGROUND

The liquid crystal display (LCD) has such advantages as thinness, power saving, no radiation and the like, and is widely applied to many fields, such as liquid crystal display televisions, mobile phones, personal digital assistants (PDA), digital cameras, computer screens or laptop screens, and the like.

The working mode of the liquid crystal display is passive lighting, so that a backlight module needs to be arranged on the incident light side of the liquid crystal display.

SUMMARY

A backlight module provided by embodiments of the present disclosure, includes a backlight source, wherein the backlight source is divided into a plurality of light-emitting areas; each of the light-emitting areas includes a plurality of light-emitting devices; the light-emitting devices in each of the light-emitting areas are mutually independent; and a backlight control circuit, wherein the backlight control circuit includes a plurality of current control circuits in one-to-one correspondence to the light-emitting areas and a backlight adjusting circuit connected to each of the current control circuits; the backlight adjusting circuit is configured to determine a working sequence of the current control circuits according to a display area scanning direction of a display; and the current control circuits are configured to control the light-emitting devices to emit light according to the working sequence determined by the backlight adjusting circuit in response to that areas corresponding to the light-emitting devices in the display areas are scanned.

In one possible implementation, in the backlight module provided by embodiments of the present disclosure, each of the light-emitting areas is divided into a plurality of light-emitting subareas which are arrayed in a column direction and extend in a line direction, each of the light-emitting subareas includes at least one light-emitting device, and each of the light-emitting subareas corresponds to at least one line of pixels in the display;

the backlight adjusting circuit is further configured to determine a scanning sequence of the light-emitting subareas in the light-emitting areas according to the display area scanning direction of the display;

the current control circuits are specifically configured to control the light-emitting devices in the light-emitting subareas to emit light according to the scanning sequence of the light-emitting subareas when lines of pixels corresponding to the light-emitting subareas are scanned.

In one possible implementation, in the backlight module provided by embodiments of the present disclosure, each light-emitting subarea includes a plurality of light-emitting groups arrayed in a line direction, and each of the light-emitting groups includes one or more light-emitting devices in series;

the current control circuits are configured to control the light-emitting devices in the light-emitting groups to emit light when pixels corresponding to the light-emitting groups are scanned.

In one possible implementation, in the backlight module provided by embodiments of the present disclosure, the current control circuits are configured to control working currents of the light-emitting groups according to gray-scale values of pixels corresponding to the light-emitting groups.

In one possible implementation, in the backlight module provided by embodiments of the present disclosure, the backlight adjusting circuit is further configured to determine brightness values corresponding to the light-emitting groups according to data of each frame of images to be displayed;

the current control circuits are configured to generate working currents to control the light-emitting groups to emit light according to the brightness values corresponding to the light-emitting groups determined by the backlight adjusting circuit.

In one possible implementation, in the backlight module provided by embodiments of the present disclosure, the backlight adjusting circuit is connected to the current control circuits through a serial peripheral interface;

the serial peripheral interface includes one input end and a plurality of output ends;

the input end is connected to the backlight adjusting circuit, and the plurality of the output ends are separately connected to the current control circuits through buses.

In one possible implementation, in the backlight module provided by embodiments of the present disclosure, the buses include a clock signal wire, a data signal wire and a boundary distinction signal wire, wherein the clock signal wire is configured to transmit clock signals;

the data signal wire is configured to transmit brightness values corresponding to the light-emitting areas; and the boundary distinction signal wire is configured to transmit control signals for controlling working states of the current control circuits.

In one possible implementation, in the backlight module provided by embodiments of the present disclosure, the backlight source is divided into 2*2 light-emitting areas, each light-emitting area is divided into 5 light-emitting subareas, and each light-emitting subarea includes 6 light-emitting groups.

On the other hand, embodiments of the present disclosure further provide a display device, including a display and a backlight module, wherein the backlight module is the backlight module provided by embodiments of the present disclosure.

On the other hand, embodiments of the present disclosure further provide a control method for the backlight module, including:

determining a working sequence of the current control circuits by the backlight adjusting circuit according to a display area scanning direction of the display; and controlling the light-emitting devices to emit light by the current control circuits in response to that areas corresponding to the light-emitting devices in the display areas are scanned.

In one possible implementation, in the control method for the backlight module provided by embodiments of the present disclosure, when each light-emitting area is divided into a plurality of light-emitting subareas, the control method further includes: determining a scanning sequence of the light-emitting subareas in the light-emitting areas by the backlight adjusting circuit according to the display area scanning direction of the display;

the controlling the light-emitting devices to emit light by the current control circuits when areas corresponding to the light-emitting devices in the display areas are scanned specifically includes: controlling the light-emitting devices in the light-emitting subareas to emit light by the current control circuits in response to that lines of pixels corresponding to the light-emitting subareas are scanned.

In one possible implementation, in the control method for the backlight module provided by embodiments of the present disclosure, when the light-emitting subareas includes a plurality of light-emitting groups, the controlling the light-emitting devices in the light-emitting subareas to emit light by the current control circuits when lines of pixels corresponding to the light-emitting subareas are scanned, includes:

controlling the light-emitting devices in the light-emitting groups to emit light by the current control circuits in response to that pixels corresponding to the light-emitting groups are scanned.

In one possible implementation, in the control method for the backlight module provided by embodiments of the present disclosure, the controlling the light-emitting devices in the light-emitting groups to emit light by the current control circuits, includes:

controlling working currents of the light-emitting groups by the current control circuits according to gray-scale values of pixels corresponding to the light-emitting groups.

In one possible implementation, in the control method for the backlight module provided by embodiments of the present disclosure, the controlling working currents of the light-emitting groups by the current control circuits according to gray-scale values of pixels corresponding to the light-emitting groups, includes:

determining brightness values corresponding to the light-emitting groups by the backlight adjusting circuit according to data of each frame of images to be displayed; and generating working currents to control the light-emitting groups to emit light by the current control circuits according to the brightness values corresponding to the light-emitting groups determined by the backlight adjusting circuit.

In one possible implementation, in the control method for the backlight module provided by embodiments of the present disclosure, in a 2D display mode, the display area scanning direction of the display is line by line from top to bottom; determining, by the backlight adjusting circuit that the working sequence of the current control circuits is from top to bottom, and determining that the scanning sequence of the light-emitting subareas in the light-emitting areas is from top to bottom;

in a 3D display mode, the display area scanning direction of the display is line by line from both top and bottom to middle; determining by the backlight adjusting circuit that the working sequence of the current control circuits is from both top and bottom to middle, and determining that the scanning sequence of the light-emitting subareas in the upper half of the light-emitting areas is from top to bottom and the scanning sequence of the light-emitting subareas in the lower half of the light-emitting areas is from bottom to top.

On the other hand, the embodiments of the present disclosure further provides a driving method for a display device, including:

driving a display to display according to a set display area scanning direction; and driving the backlight module to display by using the control method for the backlight module of the present disclosure.

DETAILED DESCRIPTION OF THE EMBODIMENTS

The present disclosure is further described in detail hereinafter in combination with the drawings so as to make the purpose, the technical scheme and the advantages of the present disclosure clearer. Apparently, the embodiments described below are only one part of rather than all embodiments of the present disclosure. Based on the embodiments in the present disclosure, all other embodiments obtained by those of ordinary skilled in the art without creative efforts belong to the protection scope of the present disclosure.

The specific implementation mode of a backlight module, a control method therefor, a display device provided by embodiments of the present disclosure will be described in detail hereinafter in combination with drawings.

Figure 1:
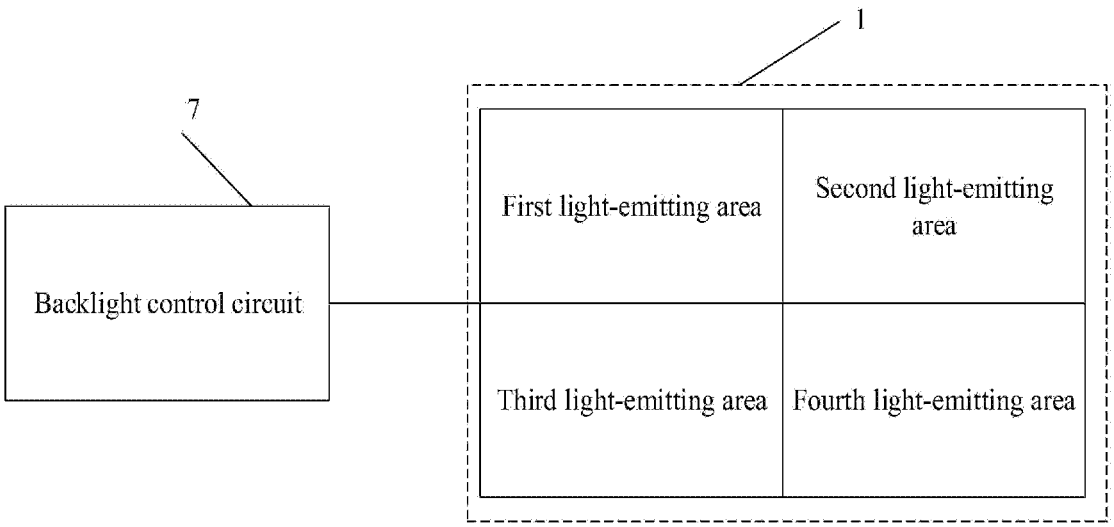
FIG. 1 is a structural schematic diagram of a backlight module for a display provided in some embodiments of the present disclosure.
Figure 2:
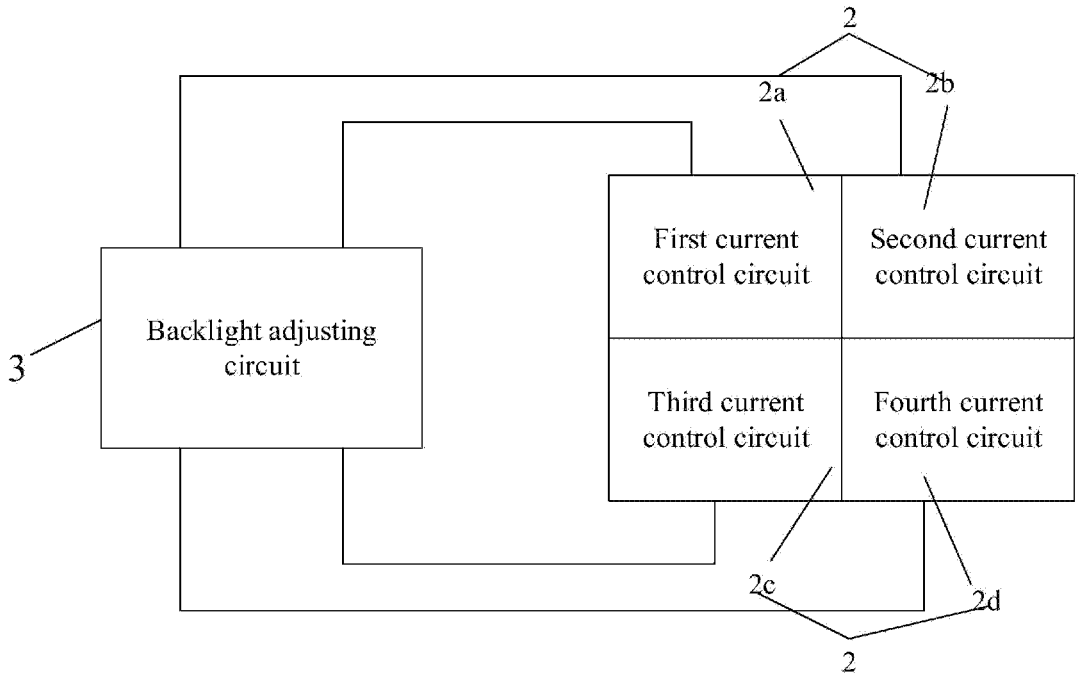
FIG. 2 is a structural schematic diagram of a backlight module for a display provided in some embodiments of the present disclosure.
Figure 3:
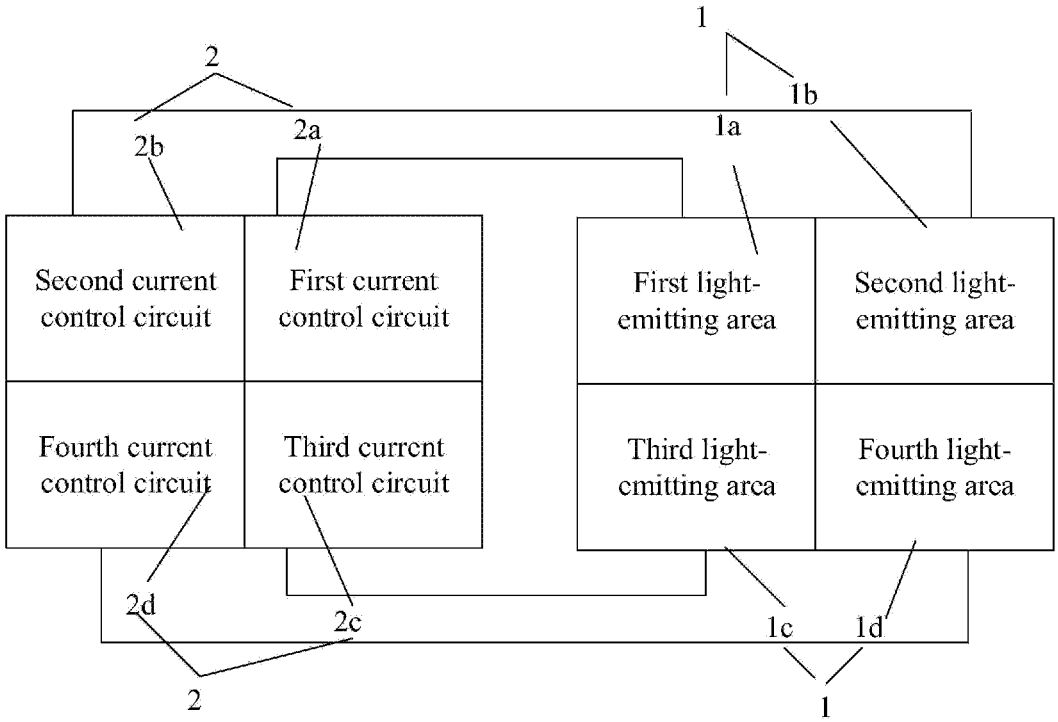
FIG. 3 is a structural schematic diagram of a backlight module for a display provided in some embodiments of the present disclosure.

A backlight module provided by embodiments of the present disclosure, as shown in FIG. 1, includes:

a backlight source 1, wherein the backlight source 1 is divided into a plurality of light-emitting areas; each light-emitting area includes a plurality of light-emitting devices; the light-emitting devices in each light-emitting area are mutually independent;

a backlight control circuit 7, as shown in FIG. 2 and FIG. 3, wherein the backlight control circuit 7 includes a plurality of current control circuits 2 in one-to-one correspondence to the light-emitting areas and a backlight adjusting circuit 3 connected to each of the current control circuits 2;

the backlight adjusting circuit 3 is configured to determine a working sequence of the current control circuits 2 according to a display area scanning direction of a display; and the current control circuits 2 are configured to control the light-emitting devices to emit light according to the working sequence determined by the backlight adjusting circuit 3 when areas corresponding to the light-emitting devices in the display areas are scanned.

Specifically, in the backlight module provided by the embodiments of the present disclosure, the backlight source 1 is divided into light-emitting areas, the light-emitting devices in each light-emitting area are mutually independent, i.e., the light-emitting devices in each light-emitting area do not have an electric connection relation. The current control circuit 2 for driving the light-emitting area to emit light is configured for each light-emitting area. The light-emitting areas in the backlight module 1 are arranged in one-to-one correspondence to the current control circuits 2, i.e., one current control circuit 2 independently controls one light-emitting area. This setting mode effectively alleviates the problem that the data processing volume of the current control circuit 2 is large because only one current control circuit 2 is set and the backlight module is controlled through one current control circuit 2 in the related art. Moreover, when display areas corresponding to the light-emitting areas are scanned, the current control circuits 2 can control the light-emitting devices in the light-emitting areas to emit light, and the light-emitting areas corresponding to areas which are not scanned in a display do not emit light, so that the light-emitting duration of each light-emitting device in the backlight source 1 is greatly shortened, and a large amount of electric energy is saved. Furthermore, crosstalk can be reduced during 3D display by cooperating the time-division drive of the light-emitting areas with the scanning mode of the display.

It should be noted that "the backlight source 1 includes a plurality of light-emitting areas" indicates that the backlight source can include a plurality of light-emitting areas of m rows×n columns, wherein m is an integer greater than or equal to 2, and n is a positive integer. Moreover, m is usually an even number, and n is usually an integer greater than or equal to 2.

Specifically, FIG. 3 describes four light-emitting areas as an example, the four light-emitting areas are a first light-emitting area 1*a*, a second light-emitting area 1*b*, a third light-emitting area 1*c* and a fourth light-emitting area 1*d*, respectively; the current control circuits 2 in one-to-one correspondence to the light-emitting areas include a first current control circuit 2*a* for controlling the first light-emitting area 1*a*, a second current control circuit 2*b* for controlling the second light-emitting area 1*b*, a third current control circuit 2*c* for controlling the third light-emitting area 1*c* and a fourth current control circuit 2*d* for controlling the fourth light-emitting area 1*d*.

Specifically, the number and the arrangement mode of the light-emitting areas in the backlight source 1 can be determined according to actual needs and are not limited herein, and only one implementation mode is described above.

It should be noted that the current control circuits 2 in the backlight module provided by the embodiments of the present disclosure can be configured to control the light-emitting devices in the corresponding light-emitting areas to emit light only when areas in the display corresponding to the light-emitting areas controlled by the current control circuits 2 are scanned. Moreover, light emitted by the light-emitting devices in the light-emitting areas can further have a proper delay within a period of time after areas of the display corresponding to the light-emitting areas are scanned so as to ensure the uniformity of images displayed by the display, wherein the delay time can be set according to the size of the display, the visual discrimination time of human eyes and other parameters.

Figure 4:
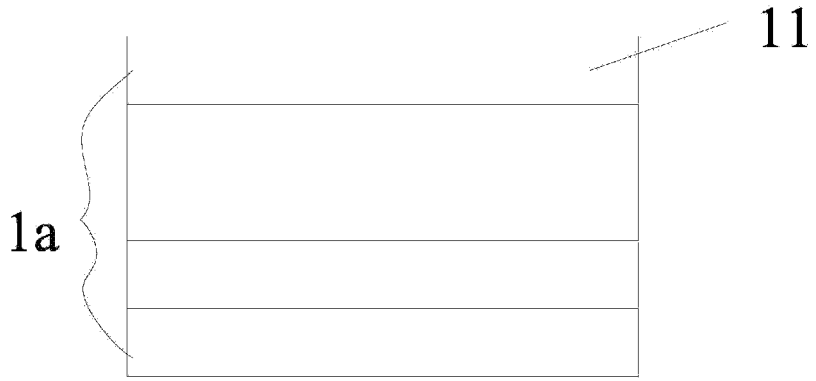
FIG. 4 is a structural schematic diagram for division of light-emitting subareas in a backlight module for a display provided in some embodiments of the present disclosure.

Optionally, in the backlight module provided by the embodiments of the present disclosure, as shown in FIG. 4, each light-emitting area can be divided into a plurality of light-emitting subareas 11 which are arrayed in a column direction and extend in a line direction, each light-emitting subarea 11 includes at least one light-emitting device, and each light-emitting subarea 11 corresponds to at least one line of pixels in the display.

The backlight adjusting circuit 3 is further configured to determine a scanning sequence of the light-emitting subareas 11 in the light-emitting areas according to the display area scanning direction of the display.

The current control circuits 2 are specifically configured to control the light-emitting devices in the light-emitting subareas 11 to emit light according to the scanning sequence of the light-emitting subareas 11 when lines of pixels corresponding to the light-emitting subareas 11 are scanned.

Specifically, each light-emitting area is further divided, i.e., each light-emitting area is subdivided so that when each light-emitting area is divided into a plurality of light-emitting subareas 11 arrayed in the column direction, the light-emitting devices in each light-emitting subarea 11 can emit light only when the line of pixels corresponding to each light-emitting subarea 11 is scanned, and the light-emitting devices in the light-emitting subarea 11 corresponding to a line of pixels which are not scanned do not emit light. Therefore, the light emitting duration of each light-emitting device in the backlight source 1 is further reduced when the display is displaying, and the consumption of electric energy by the backlight source 1 is saved.

It should be noted that in the backlight module provided by the embodiments of the present disclosure, light emitted by the light-emitting devices in the light-emitting subareas 11 can further have a proper delay within a period of time after areas of the display corresponding to the light-emitting subareas 11 are scanned so as to ensure the uniformity of images displayed by the display, wherein the delay time can be set according to the size of the display, the visual discrimination time of human eyes and other parameters.

Figure 5:
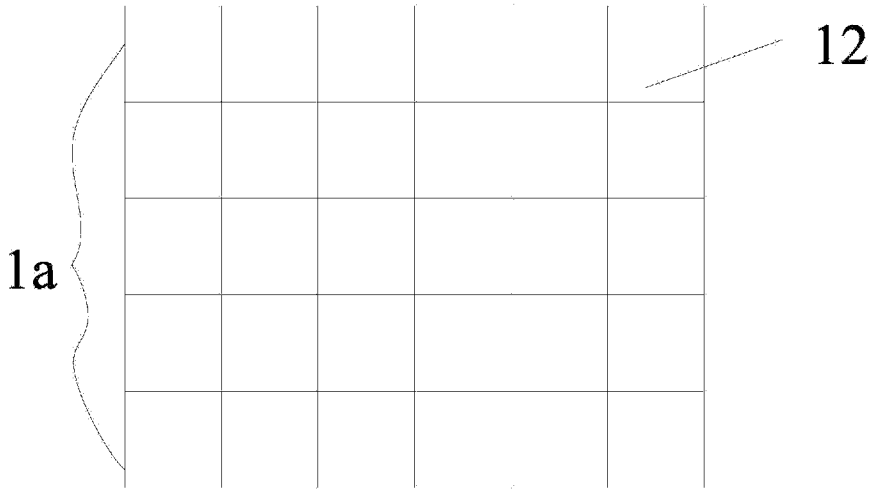
FIG. 5 is a structural schematic diagram for division of light-emitting groups in a backlight module for a display provided in some embodiments of the present disclosure.

Optionally, in the backlight module provided by the embodiments of the present disclosure, as shown in FIG. 5, each light-emitting subarea 11 can include a plurality of light-emitting groups 12 arrayed in the line direction; each light-emitting group 12 includes one or more light-emitting devices in series; and each light-emitting group 12 corresponds to one or more pixels in the display.

The current control circuits 2 are specifically configured to control the light-emitting devices in the light-emitting groups 12 to emit light when pixels corresponding to the light-emitting groups 12 are scanned.

Specifically, in the backlight module provided by the embodiments of the present disclosure, each light-emitting subarea 11 is further subdivided into a plurality of light-emitting groups 12, and the current control circuit 2 drives each light-emitting group 12 in a time-division mode, i.e., when pixels corresponding to each light-emitting group 12 are scanned, the current control circuit 2 controls the light-emitting devices in the light-emitting group 12 to emit light, and when pixels corresponding to each light-emitting group 12 are not scanned, the light-emitting devices in each light-emitting group 12 do not emit light. This driving mode greatly shortens the light emitting time of each light-emitting device in the backlight source 1, so that the purpose of saving energy is achieved.

It should be noted that in the backlight module provided by the embodiments of the present disclosure, light emitted by the light-emitting devices in the light-emitting groups 12 can further have a proper delay within a period of time after areas of the display corresponding to the light-emitting groups 12 are scanned so as to ensure the uniformity of images displayed by the display, wherein the delay time can be set according to the size of the display, the visual discrimination time of human eyes and other parameters.

Optionally, in the backlight module provided by the embodiments of the present disclosure, the current control circuits 2 are specifically configured to control working currents of the light-emitting groups 12 according to gray-scale values of the pixels corresponding to the light-emitting groups 12. Therefore, the brightness of the corresponding light-emitting group 12 can be adjusted according to the gray scale required for display so as to improve display contrast.

Optionally, in the backlight module provided by the embodiments of the present disclosure, the backlight adjusting circuit 3 is further configured to determine brightness values corresponding to the light-emitting groups 12 according to data of each frame of images to be displayed.

The current control circuits 2 are specifically configured to generate working currents to control the light-emitting groups 12 to emit light according to the brightness values corresponding to the light-emitting groups 12 determined by the backlight adjusting circuit 3.

Specifically, the backlight adjusting circuit 3 calculates the required brightness value corresponding to each light-emitting group 12 according to the gray-scale value of an image to be displayed in corresponding pixels of each light-emitting group 12 so as to increase the contrast of the displayed image. The current control circuits 2 generate currents to control the light-emitting groups to emit light according to the brightness values corresponding to the light-emitting groups 12 determined by the backlight adjusting circuit 3. When the corresponding pixels are scanned, the current control circuits 2 control the light-emitting groups 12 corresponding to the scanned pixels to emit light with corresponding brightness values, so that the contrast between the images in the areas can be increased, and image display becomes more clear and vivid.

Figure 6:
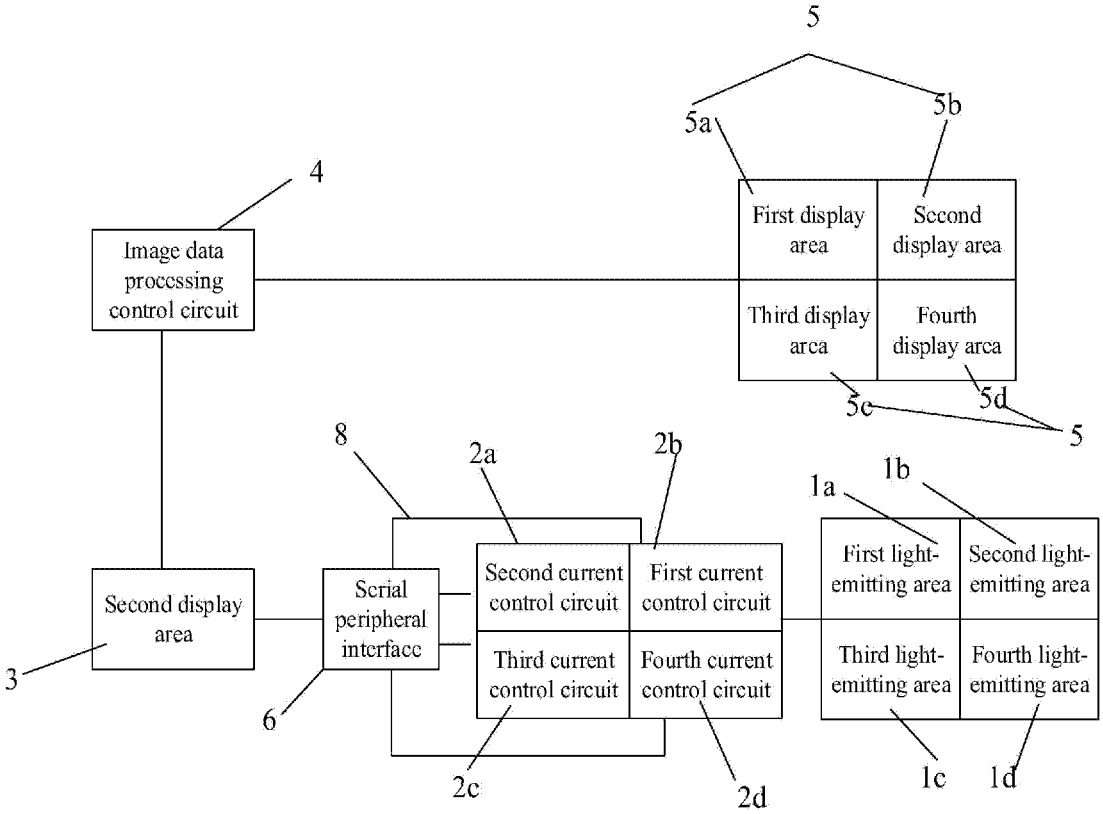
FIG. 6 is a structural schematic diagram of a display device provided in some embodiments of the present disclosure.

Optionally, in the backlight module provided by the embodiments of the present disclosure, as shown in FIG. 6, the backlight adjusting circuit 3 can be connected to the current control circuits 2 through a serial peripheral interface 6.

The serial peripheral interface 6 generally includes one input end and a plurality of output ends; and the input end is connected to the backlight adjusting circuit 3, and the plurality of the output ends are separately connected to the current control circuits 2 through buses 8.

Optionally, in the backlight module provided by the embodiments of the present disclosure, the buses 8 specifically include a clock signal wire, a data signal wire and a boundary distinction signal wire, wherein the clock signal wire is configured to transmit clock signals;

the data signal wire is configured to transmit brightness values corresponding to the light-emitting areas; and the boundary distinction signal wire is configured to transmit control signals for controlling working states of the current control circuits 2.

Based on the same inventive concept, the embodiments of the present disclosure further provide a control method for the backlight module, including:

determining a working sequence of the current control circuits by the backlight adjusting circuit according to a display area scanning direction of the display; and controlling the light-emitting devices to emit light by the current control circuits when areas corresponding to the light-emitting devices in the display areas are scanned.

Optionally, in the control method for the backlight module provided by the embodiments of the present disclosure, when each light-emitting area is divided into a plurality of light-emitting subareas, the control method further includes: determining a scanning sequence of the light-emitting subareas in the light-emitting areas by the backlight adjusting circuit according to the display area scanning direction of the display.

The controlling the light-emitting devices to emit light by the current control circuits when areas corresponding to the light-emitting devices in the display areas are scanned specifically includes: controlling the light-emitting devices in the light-emitting subareas to emit light by the current control circuits when rows of pixels corresponding to the light-emitting subareas are scanned.

Optionally, in the control method for the backlight module provided by the embodiments of the present disclosure, when the light-emitting subarea includes a plurality of light-emitting groups, the controlling the light-emitting devices in the light-emitting subareas to emit light by the current control circuits when lines of pixels corresponding to the light-emitting subareas are scanned specifically includes:

controlling the light-emitting devices in the light-emitting groups to emit light by the current control circuits when pixels corresponding to the light-emitting groups are scanned.

Optionally, in the control method for the backlight module provided by the embodiments of the present disclosure, the controlling the light-emitting devices in the light-emitting groups to emit light by the current control circuits specifically includes:

controlling working currents of the light-emitting groups by the current control circuits according to gray-scale values of pixels corresponding to the light-emitting groups.

Optionally, in the control method for the backlight module provided by the embodiments of the present disclosure, the controlling working currents of the light-emitting groups by the current control circuits according to gray-scale values of pixels corresponding to the light-emitting groups specifically includes:

determining brightness values corresponding to the light-emitting groups by the backlight adjusting circuit according to data of each frame of images to be displayed; and generating working currents to control the light-emitting groups to emit light by the current control circuits according to the brightness values corresponding to the light-emitting groups determined by the backlight adjusting circuit.

Optionally, in the control method for the backlight module provided by the embodiments of the present disclosure, in a 2D display mode, the display area scanning direction of the display is line by line from top to bottom; the backlight adjusting circuit determines that the working sequence of the current control circuits is from top to bottom, and determines that the scanning sequence of the light-emitting subareas in the light-emitting areas is from top to bottom.

In a 3D display mode, the display area scanning direction of the display is line by line from both top and bottom to middle; the backlight adjusting circuit determines that the working sequence of the current control circuits is from both top and bottom to middle, and determines that the scanning sequence of the light-emitting subareas in the upper half of the light-emitting areas is from top to bottom and the scanning sequence of the light-emitting subareas in the lower half of the light-emitting areas is from bottom to top.

Specifically, line-by-line scanning from both top and bottom to middle is as follows: scanning the first line, then the last line, next the second line, then last but one line, and so on. This scanning sequence can avoid crosstalk of two adjacent lines.

Specifically, in the 3D display mode and the 2D display mode, the scanning mode of the backlight module is set according to the display area scanning mode of the display.

The backlight module and the control method therefor are described in detail by taking the following scheme as an example: the backlight source 1 includes four light-emitting areas, each light-emitting area includes 5 light-emitting subareas arrayed in the line direction and each light-emitting subarea includes 6 light-emitting groups:

as shown in FIG. 6, the display 5 can be divided into four display areas: a first display area 5*a*, a second display area 5*b*, a third display area 5*c* and a fourth display area 5*d*, the display areas display image data sent by an image data processing control circuit 4 line by line in different areas, i.e., the first display area 5*a*, the second display area 5*b*, the third display area 5*c* and the fourth display area 5*d* display the data sequentially, and pixels are scanned in each display area line by line; the backlight adjusting circuit 3 determines the required brightness value corresponding to each light-emitting group 12 in the backlight source 1 according to a gray-scale value of each frame of images to be displayed, sent by the image data processing control circuit 4.

The backlight adjusting circuit 3 transmits the calculated brightness value of each light-emitting area of the backlight source 1 to the current control circuit 2 corresponding to each light-emitting area through the serial peripheral interface 6 and the buses 8. The current control circuits 2 comprise a first current control circuit 2*a*, a second current control circuit 2*b*, a third current control circuit 2*c* and a fourth current control circuit 2*d*.

Figure 7:
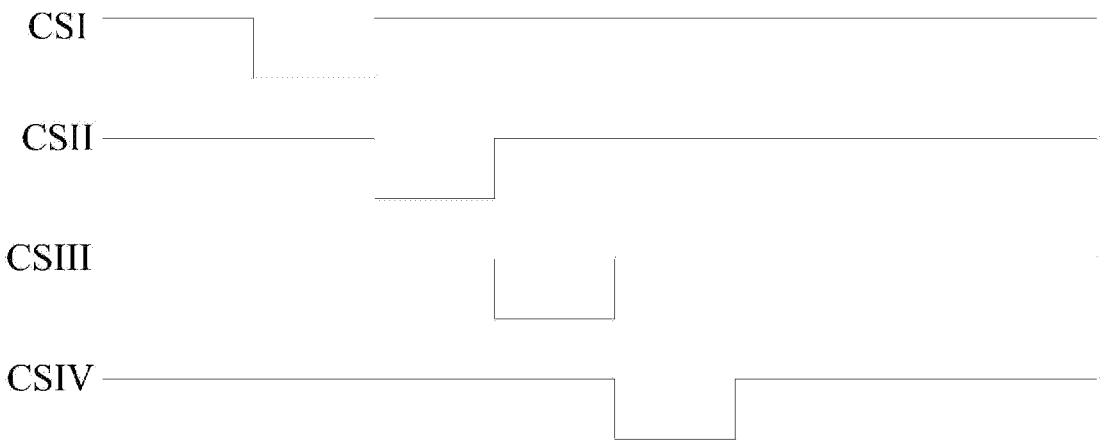
FIG. 7 is a time sequence diagram for a backlight adjusting circuit to transmit data to current control circuits provided in some embodiments of the present disclosure.

The backlight adjusting circuit 3 sends the time sequence of data to each current control circuit through the serial peripheral interface 6. As shown in FIG. 7, when the control signal CSI input to the first current control circuit 2*a* is a low-level signal, the backlight adjusting circuit 3 sends the data corresponding to the first current control circuit 2*a* to the first current control circuit 2*a*; when the control signal CSII input to the second current control circuit 2*b* is a low-level signal, the backlight adjusting circuit 3 sends the data corresponding to the second current control circuit 2*b* to the second current control circuit 2*b*; and when the control signal CSIII input to the third current control circuit 2*c* is a low-level signal, the backlight adjusting circuit 3 sends the data corresponding to the third current control circuit 2*c* to the third current control circuit 2*c*; and when the control signal CSIV input to the fourth current control circuit 2*d* is a low-level signal, the backlight adjusting circuit 3 sends the data corresponding to the fourth current control circuit 2*d* to the fourth current control circuit 2*d*. A low level is taken as an effective signal for control. Surely, the effective signal can also be a high-level signal, which is not limited herein.

Specifically, the data received by each current control circuit 2 includes 32 bytes. Because the light-emitting area corresponding to each current control circuit 2 includes 30 light-emitting groups 12, each current control circuit 2 includes at least 30 output pins, and each output pin is connected to one corresponding light-emitting group 12, wherein the brightness value of each light-emitting group 12 corresponds to one byte, one device identification byte is included in front of the 30 light-emitting group bytes, and one check byte is included behind the 30 light-emitting group bytes and is used for checking the correctness of data transmission.

When the current control circuits 2 control the light-emitting areas, one current control circuit 2 corresponds to one light-emitting area. As shown in FIG. 6, the first current control circuit 2*a* controls the first light-emitting area 1*a*, the second current control circuit 2*b* controls the second light-emitting area 1*b*, the third current control circuit 2*c* controls the third light-emitting area 1*c* and the fourth current control circuit 2*d* controls the fourth light-emitting area 1*d*. This setting mode can reduce the data processing volume of a single current control circuit so as to reduce the requirement for the processing capability of a single current control circuit.

Figure 8:
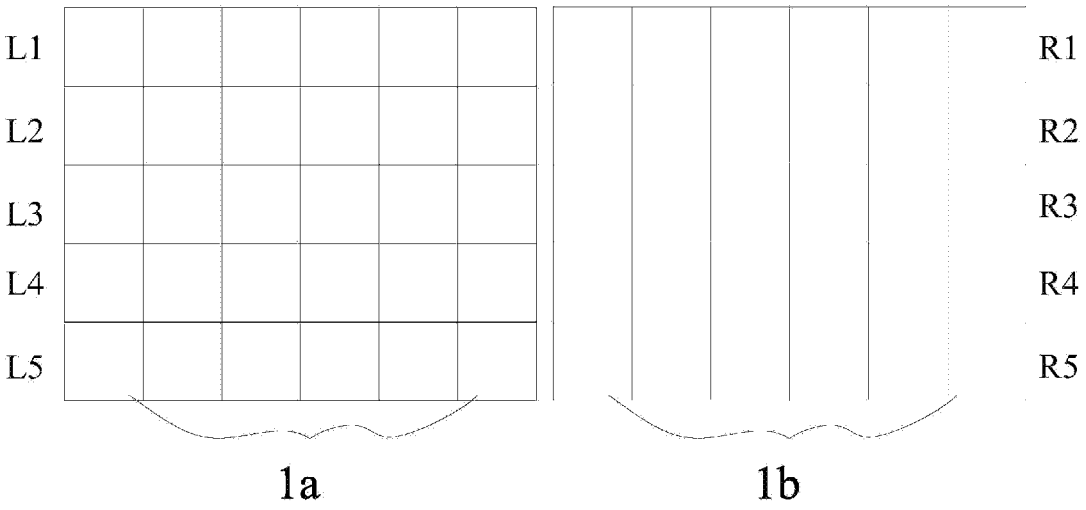
FIG. 8 is a structural division diagram of two light-emitting areas provided in some embodiments of the present disclosure.
Figure 9:
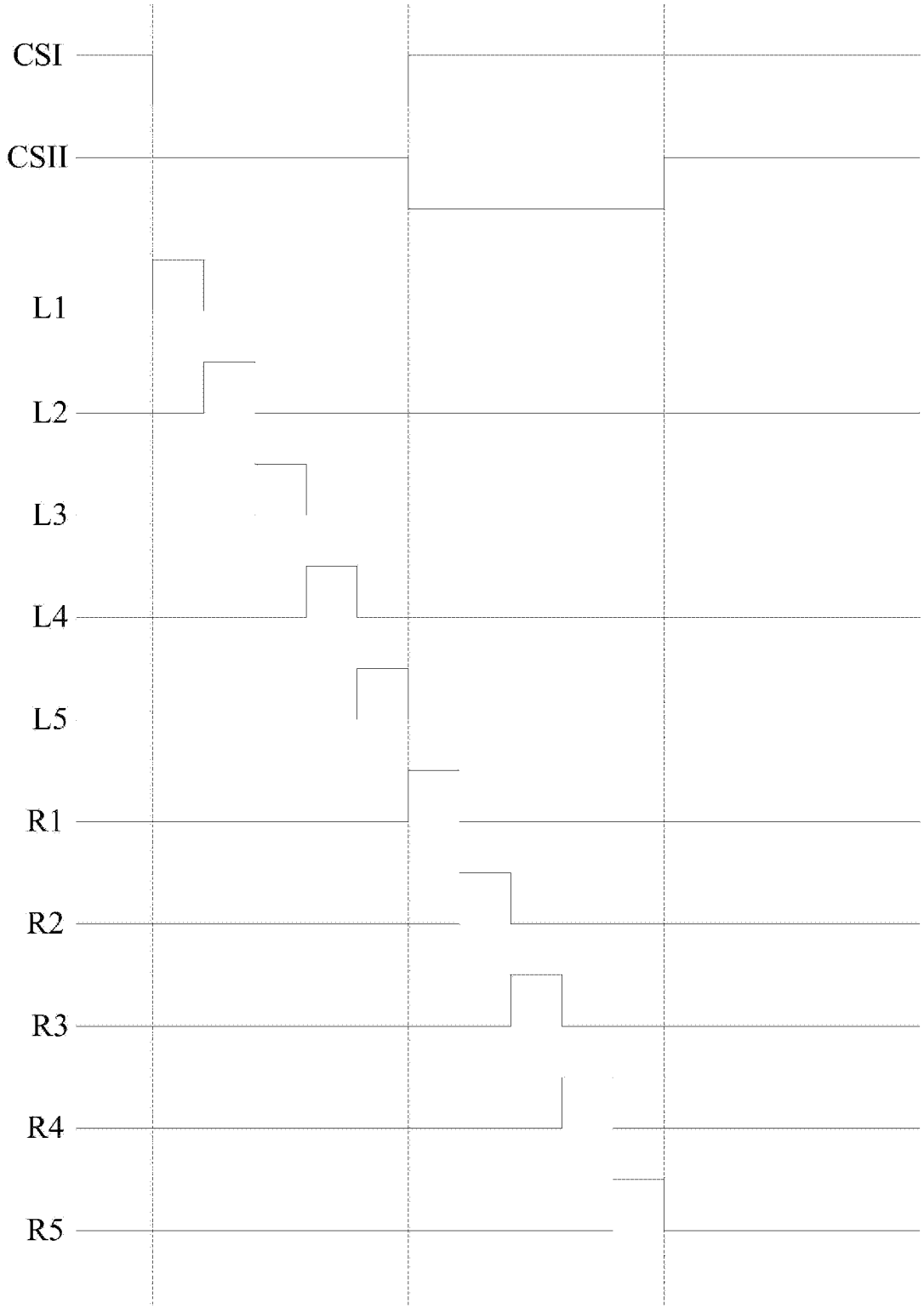
FIG. 9 is a time sequence diagram for two current control circuits to control two light-emitting areas provided in some embodiments of the present disclosure.

Because the pixels in each display area are scanned line by line during image display, each light-emitting area in the backlight source 1 is also scanned line by line so as to cooperate with the display effect of each display area in the display. By taking the following scheme as an example: the first current control circuit 2*a* controls the first light-emitting area 1*a*, and the second current control circuit 2*b* controls the second light-emitting area 1*b*, as shown in FIG. 8, each light-emitting area includes 5 lines of light-emitting subareas 11, each light-emitting subarea 11 includes 6 light-emitting groups 12, i.e., each light-emitting area includes 30 light-emitting groups 12, and each light-emitting group 12 includes one or more light-emitting devices in series. The specific time sequence for controlling each light-emitting area is shown in FIG. 9, and signals are input for L1, L2, L3, L4 and L5 successively, so that the light-emitting subareas located in L1, L2, L3, L4 and L5 emit light line by line, i.e., each light-emitting area emits light sequentially by taking the light-emitting subareas 11 as a unit. After the light-emitting area where L1, L2, L3, L4 and L5 are located finishes emitting light line by line, the next light-emitting area starts to emit light line by line, i.e., signals are input for R1, R2, R3, R4 and R5 sequentially, so that the light-emitting subareas located in R1, R2, R3, R4 and R5 emit light line by line.

All light-emitting areas in the backlight source 1 emit light one by one. When the video source signals are 2D signals, because the pixels in each display area are scanned line by line from top to bottom during image display in the 2D display mode, the light-emitting subareas 11 in each light-emitting area are also scanned line by line from top to bottom. When the video source signals are 3D signals, because the pixels in the first display area 5*a* and the second display area 5*b* are scanned line by line from top to bottom and the pixels in the third display area 5*c* and the fourth display area 5*d* are scanned line by line from bottom to top during image display in the 3D display mode, the first light-emitting area 1*a* and the second light-emitting area 1*b* are scanned line by line from top to bottom, and the third light-emitting area 1*c* and the fourth light-emitting area 1*d* are scanned line by line from bottom to top. This scanning mode can reduce energy consumption and crosstalk, so that image display becomes more vivid.

Usually each light-emitting subarea 11 corresponds to multiple lines of pixels of the display, and the light-emitting subarea 11 is off only after the multiple lines of corresponding pixels are completely scanned so as to avoid the condition that the light-emitting subarea 11 is frequently on and off during line-by-line scanning of the pixels. The time for refreshing the entire screen of the backlight source 1 is much less than the time for refreshing one frame of pixels. For example, if the backlight source 1 includes four light-emitting areas, each light-emitting area includes 32 bytes and each byte includes 8 bits and has the refreshing frequency of 4 MHZ, then the time required for refreshing the entire backlight source 1 once is: 1/4000000*32*8*4=0.256 ms, while the time required for refreshing one frame of image is 1/60=16.67 ms. Therefore, it can be seen that the time for refreshing the entire screen of the backlight source 1 is far less than the time for refreshing one frame of pixels, i.e., the refreshing ability of the backlight source 1 is greater than that of each frame of image. Therefore, the condition that during refreshing of pixels, a situation in which the backlight source 1 is not on, can be avoided, and the normal display of the image can be effectively guaranteed.

Moreover, by taking the following scheme as an example: each light-emitting area includes 5 lines of light-emitting subareas and one frame includes 1920*1080 pixels, the pixels in each line plus blank pixels equal to 1125 pixels, and the on time of each line of the light-emitting subarea 11 in each light-emitting area is 1/60/1125*1080/5=0.0032 s, which can meet the requirement that the light-emitting subarea is off only after the pixels of the display area corresponding to the light-emitting subarea 11 are scanned so as to ensure display quality.

Based on the same inventive concept, the embodiments of the present disclosure further provide a display device, including a display and a backlight module, wherein the backlight module is any one of the above backlight modules. The display device can be any liquid crystal display device having energy saving demands, such as liquid crystal displays, large-scale outdoor advertising panels, and the like. Because the principle of the display device to solve problems is similar to that of the backlight module, the implementation of the display device can refer to the embodiments of the backlight module. The repetitions will not be introduced herein.

Based on the same inventive concept, the embodiments of the present disclosure further provide a driving method for the display device. Because the principle of the driving method to solve problems is similar to that of the control method for a backlight module, the implementation of the driving method can refer to the embodiments of the control method. The repetitions will not be introduced herein.

Specifically, the driving method for the display device provided by the embodiments of the present disclosure specifically includes:

driving a display to display according to a set display area scanning direction; and driving the backlight module to display by using the control method for the backlight module in the present disclosure.

According to the backlight module, the control method therefor and the display device, the driving method therefor provided by the embodiments of the present disclosure, the backlight source is divided into the light-emitting areas, and the current control circuit for driving the light-emitting area to emit light is configured for each light-emitting area. Each light-emitting area in the backlight module is arranged in one-to-one correspondence to the current control circuit, i.e., one current control circuit independently controls one light-emitting area. This setting mode effectively alleviates the problem that the data processing volume of the current control circuit is large because only one current control circuit is configured and the backlight module is controlled through one current control circuit in related arts. Moreover, when display areas corresponding to the light-emitting areas are scanned, the current control circuits can control the light-emitting devices in the light-emitting areas to emit light, and the light-emitting areas corresponding to areas which are not scanned in the display do not emit light, so that the light-emitting duration of each light-emitting device in the backlight source is greatly shortened, and a large amount of electric energy is saved. Furthermore, crosstalk can be reduced during 3D display by cooperating the time-division drive of the light-emitting areas with the scanning mode of the display.

Apparently, those of ordinary skilled in the art can make various modifications and transformations on the present disclosure without deviating from the spirit and scope of the present disclosure. Thus, if these modifications and transformations of the present disclosure belong to the scope of the claims and equivalent technologies of the present disclosure, the present disclosure is also intended to include these modifications and transformations.

The invention claimed is:

1. A backlight module, comprising a backlight source, wherein the backlight source is divided into a plurality of light-emitting areas; each of the light-emitting areas comprises a plurality of light-emitting devices; the light-emitting devices in each of the light-emitting areas are mutually independent; and a backlight control circuit, wherein the backlight control circuit comprises a plurality of current control circuits in one-to-one correspondence to the light-emitting areas and a backlight adjusting circuit connected to each of the current control circuits; the backlight adjusting circuit is configured to determine a working sequence of the current control circuits according to a display area scanning direction of a display; and the current control circuits are configured to control the light-emitting devices to emit light according to the working sequence determined by the backlight adjusting circuit in response to that areas corresponding to the light-emitting devices in the display areas are scanned;

wherein the backlight adjusting circuit is connected to the current control circuits through a serial peripheral interface, wherein the serial peripheral interface comprises one input end and a plurality of output ends; the input end is connected to the backlight adjusting circuit; and the plurality of the output ends are separately connected to the current control circuits through buses;

wherein the buses comprise a clock signal wire, a data signal wire and a boundary distinction signal wire, wherein the clock signal wire is configured to transmit clock signals;

the data signal wire is configured to transmit brightness values corresponding to the light-emitting areas; and the boundary distinction signal wire is configured to transmit control signals for controlling working states of the current control circuits.

2. The backlight module of claim 1, wherein each of the light-emitting areas is divided into a plurality of light-emitting subareas which are arrayed in a column direction and extend in a line direction, each of the light-emitting subareas comprises at least one light-emitting device, and the light-emitting subarea corresponds to at least one line of pixels in the display;

the backlight adjusting circuit is further configured to determine a scanning sequence of the light-emitting subareas in the light-emitting areas according to the display area scanning direction of the display; and the current control circuits are configured to control the light-emitting devices in the light-emitting subareas to emit light according to the scanning sequence of the light-emitting subareas in response to that lines of pixels corresponding to the light-emitting subareas are scanned.

3. The backlight module of claim 2, wherein each of the light-emitting subareas comprises a plurality of light-emitting groups arrayed in a line direction, and each of the light-emitting groups comprises one or more light-emitting devices in series; and the current control circuits are configured to control the light-emitting devices in the light-emitting groups to emit light in response to that pixels corresponding to the light-emitting groups are scanned.

4. The backlight module of claim 3, wherein the current control circuits are configured to control working currents of the light-emitting groups according to gray-scale values of pixels corresponding to the light-emitting groups.

5. The backlight module of claim 4, wherein the backlight adjusting circuit is further configured to determine brightness values corresponding to the light-emitting groups according to data of each frame of images to be displayed; and the current control circuits are configured to generate working currents to control the light-emitting groups to emit light according to the brightness values corresponding to the light-emitting groups determined by the backlight adjusting circuit.

6. The backlight module of claim 3, wherein the backlight source is divided into 2*2 light-emitting areas, each light-emitting area is divided into 5 light-emitting subareas, and each light-emitting subarea comprises 6 light-emitting groups.

7. A display device, comprising a display and the backlight module of any one of claim 1.

8. A control method for the backlight module of claim 1, comprising:

determining a working sequence of the current control circuits by a backlight adjusting circuit according to a display area scanning direction of a display; and controlling the light-emitting devices to emit light by the current control circuits in response to that areas corresponding to the light-emitting devices in the display areas are scanned.

9. The control method for the backlight module of claim 8, when the light-emitting areas are divided into a plurality of light-emitting subareas, further comprising: determining a scanning sequence of the light-emitting subareas in the light-emitting areas by the backlight adjusting circuit according to the display area scanning direction of the display; and the controlling the light-emitting devices to emit light by the current control circuits in response to that areas corresponding to the light-emitting devices in the display areas are scanned, comprises: controlling the light-emitting devices in the light-emitting subareas to emit light by the current control circuits in response to that lines of pixels corresponding to the light-emitting subareas are scanned.

10. The control method for the backlight module of claim 9, wherein when the light-emitting subareas comprises a plurality of light-emitting groups, the controlling the light-emitting devices in the light-emitting subareas to emit light by the current control circuits when lines of pixels corresponding to the light-emitting subareas are scanned, comprises: controlling the light-emitting devices in the light-emitting groups to emit light by the current control circuits in response to that pixels corresponding to the light-emitting groups are scanned.

11. The control method for the backlight module of claim 10, wherein the controlling the light-emitting devices in the light-emitting groups to emit light by the current control circuits, comprise:

controlling working currents of the light-emitting groups by the current control circuits according to gray-scale values of pixels corresponding to the light-emitting groups.

12. The control method for the backlight module of claim 11, wherein the controlling working currents of the light-emitting groups by the current control circuits according to gray-scale values of pixels corresponding to the light-emitting groups, comprises:

determining brightness values corresponding to the light-emitting groups by the backlight adjusting circuit according to data of each frame of images to be displayed; and generating working currents to control the light-emitting groups to emit light by the current control circuits according to the brightness values corresponding to the light-emitting groups determined by the backlight adjusting circuit.

13. The control method for the backlight module of claim 9, wherein in a 2D display mode, the display area scanning direction of the display is line by line from top to bottom; determining, by the backlight adjusting circuit that the working sequence of the current control circuits is from top to bottom, and determining that the scanning sequence of the light-emitting subareas in the light-emitting areas is from top to bottom; and in a 3D display mode, the display area scanning direction of the display is line by line from both top and bottom to middle; determining, by the backlight adjusting circuit that the working sequence of the current control circuits is from both top and bottom to middle, and determining that the scanning sequence of the light-emitting subareas in a upper half of the light-emitting areas is from top to bottom and the scanning sequence of the light-emitting subareas in a lower half of the light-emitting areas is from bottom to top.

14. A driving method for a display device, comprising:

driving a display to display according to a set display area scanning direction; and driving the backlight module to display by using the control method for the backlight module of claim 8.

* * * * *